US006543733B1

(12) United States Patent
Pennington

(10) Patent No.: US 6,543,733 B1
(45) Date of Patent: Apr. 8, 2003

(54) WATER TROUGH SUPPORT APPARATUS

(76) Inventor: Michael C. Pennington, 118 Buckhurst Avenue, Carshalton Surrey SM5 1PF (GB)

( * ) Notice: Subject to any disclaimer, the term of this patent is extended or adjusted under 35 U.S.C. 154(b) by 0 days.

(21) Appl. No.: 09/827,779

(22) Filed: Apr. 6, 2001

(51) Int. Cl.[7] ..... A47G 23/02; A47B 9/20

(52) U.S. Cl. ..... 248/149; 248/127; 248/176.1; 248/188.2; 248/354.2; 108/147.21

(58) Field of Search ..... 248/150, 165, 248/166, 439, 176.1, 188.6, 188.8, 447, 454, 149, 125.5, 188.5, 188.2, 354.5; 108/27, 145, 147.19, 147.2, 147.21, 116, 120; 211/175, 208

(56) References Cited

U.S. PATENT DOCUMENTS

| | | | | | |
|---|---|---|---|---|---|
| 3,606,846 | A | * | 9/1971 | Andrews | 108/132 |
| 4,148,264 | A | * | 4/1979 | Caravias | 108/145 |
| 4,273,306 | A | * | 6/1981 | Chang | 248/421 |
| D268,135 | S | | 3/1983 | Habro | |
| 4,520,935 | A | * | 6/1985 | Churchill | 211/124 |
| 4,842,229 | A | | 6/1989 | Murray | |
| 4,869,501 | A | * | 9/1989 | Anastasakis | 273/1.5 |
| RE33,645 | E | * | 7/1991 | Coote | 248/129 |
| 5,141,197 | A | * | 8/1992 | Mackaay | 248/439 |
| 5,193,773 | A | | 3/1993 | Middleton | |
| 5,249,397 | A | | 10/1993 | Monaco | |
| 5,339,921 | A | | 8/1994 | Faupel | |
| 5,558,306 | A | | 9/1996 | Binford et al. | |
| 5,660,637 | A | * | 8/1997 | Dodge | 118/500 |
| 6,240,856 | B1 | * | 6/2001 | Paskey | 108/146 |

OTHER PUBLICATIONS

U.S. patent application Publicatin US 2002/0007981, filed Apr. 2, 2001 priority to Apr. 3, 2000. Stoneburg.*

* cited by examiner

*Primary Examiner*—Leslie A. Braun
*Assistant Examiner*—Amy J. Sterling

(57) ABSTRACT

A water trough support apparatus for supporting a water trough on a flight of stairs, in particular. The water trough support apparatus includes an adjustable leg assembly; and also includes a platform support member being adjustably mounted upon the leg assembly; and further includes a platform being securely mounted upon the platform support member.

1 Claim, 3 Drawing Sheets

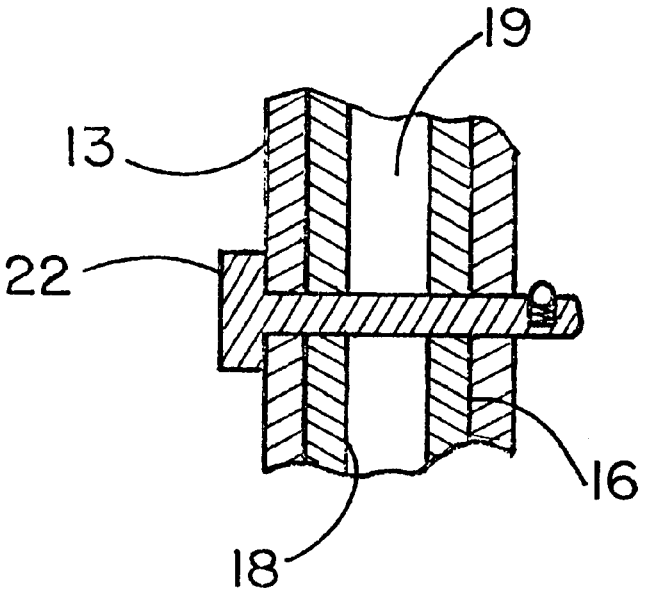
FIG. 3
FIG. 4
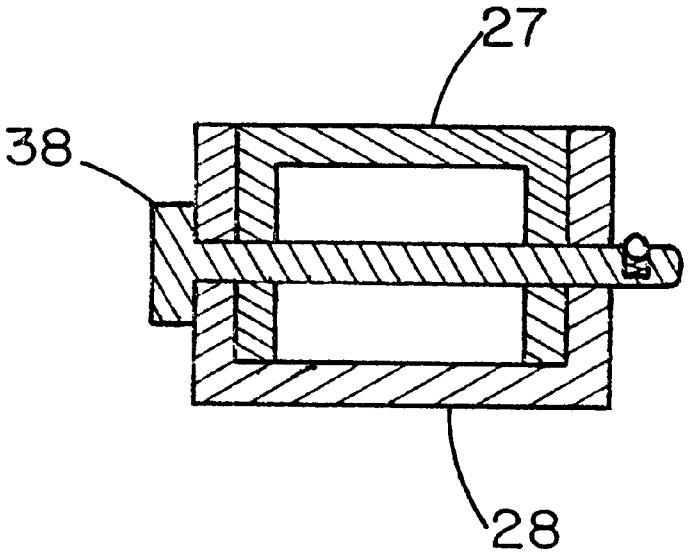

WATER TROUGH SUPPORT APPARATUS

BACKGROUND OF THE INVENTION

1. Field of the Invention

The present invention relates to a water tank support and more particularly pertains to a new water trough support apparatus for supporting a water trough on a flight of stairs, in particular.

2. Description of the Prior Art

The use of a water tank support is known in the prior art. More specifically, a water tank support heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,249,397; 5,193,773; 4,842,229; 5,339,921; 5,558,306; and U.S. Pat. No. Des. 268,135.

While these devices fulfill their respective, particular objectives and requirements, the aforementioned patents do not disclose a new water trough support apparatus. The inventive device includes an adjustable leg assembly; and also includes a platform support member being adjustably mounted upon the leg assembly; and further includes a platform being securely mounted upon the platform support member.

In these respects, the water trough support apparatus according to the present invention substantially departs from the conventional concepts and designs of the prior art, and in so doing provides an apparatus primarily developed for the purpose of supporting a water trough on a flight of stairs, in particular.

SUMMARY OF THE INVENTION

In view of the foregoing disadvantages inherent in the known types of water tank support now present in the prior art, the present invention provides a new water trough support apparatus construction wherein the same can be utilized for supporting a water trough on a flight of stairs, in particular.

The general purpose of the present invention, which will be described subsequently in greater detail, is to provide a new water trough support apparatus which has many of the advantages of the water tank support mentioned heretofore and many novel features that result in a new water trough support apparatus which is not anticipated, rendered obvious, suggested, or even implied by any of the prior art water tank support, either alone or in any combination thereof.

To attain this, the present invention generally comprises an adjustable leg assembly; and also includes a platform support member being adjustably mounted upon the leg assembly; and further includes a platform being securely mounted upon the platform support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new water trough support apparatus which has many of the advantages of the water tank support mentioned heretofore and many novel features that result in a new water trough support apparatus which is not anticipated, rendered obvious, suggested, or even implied by any of the prior art water tank support, either alone or in any combination thereof.

It is another object of the present invention to provide a new water trough support apparatus which may be easily and efficiently manufactured and marketed.

It is a further object of the present invention to provide a new water trough support apparatus which is of a durable and reliable construction.

An even further object of the present invention is to provide a new water trough support apparatus which is susceptible of a low cost of manufacture with regard to both materials and labor, and which accordingly is then susceptible of low prices of sale to the consuming public, thereby making such water trough support apparatus economically available to the buying public.

Still yet another object of the present invention is to provide a new water trough support apparatus which provides in the apparatuses and methods of the prior art some of the advantages thereof, while simultaneously overcoming some of the disadvantages normally associated therewith.

Still another object of the present invention is to provide a new water trough support apparatus for supporting a water trough on a flight of stairs, in particular.

Yet another object of the present invention is to provide a new water trough support apparatus which includes an adjustable leg assembly; and also includes a platform support member being adjustably mounted upon the leg assembly; and further includes a platform being securely mounted upon the platform support member.

Still yet another object of the present invention is to provide a new water trough support apparatus that is ideally suited for paperhangers and professional interior decorators.

Even still another object of the present invention is to provide a new water trough support apparatus that effectively supports water troughs upon the most difficult locations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the leg assembly of present invention.

FIG. 4 is a cross-sectional view of the platform support member of the present invention.

DESCRIPTION OF THE PREFERRED EMBODIMENT

Figure 1:
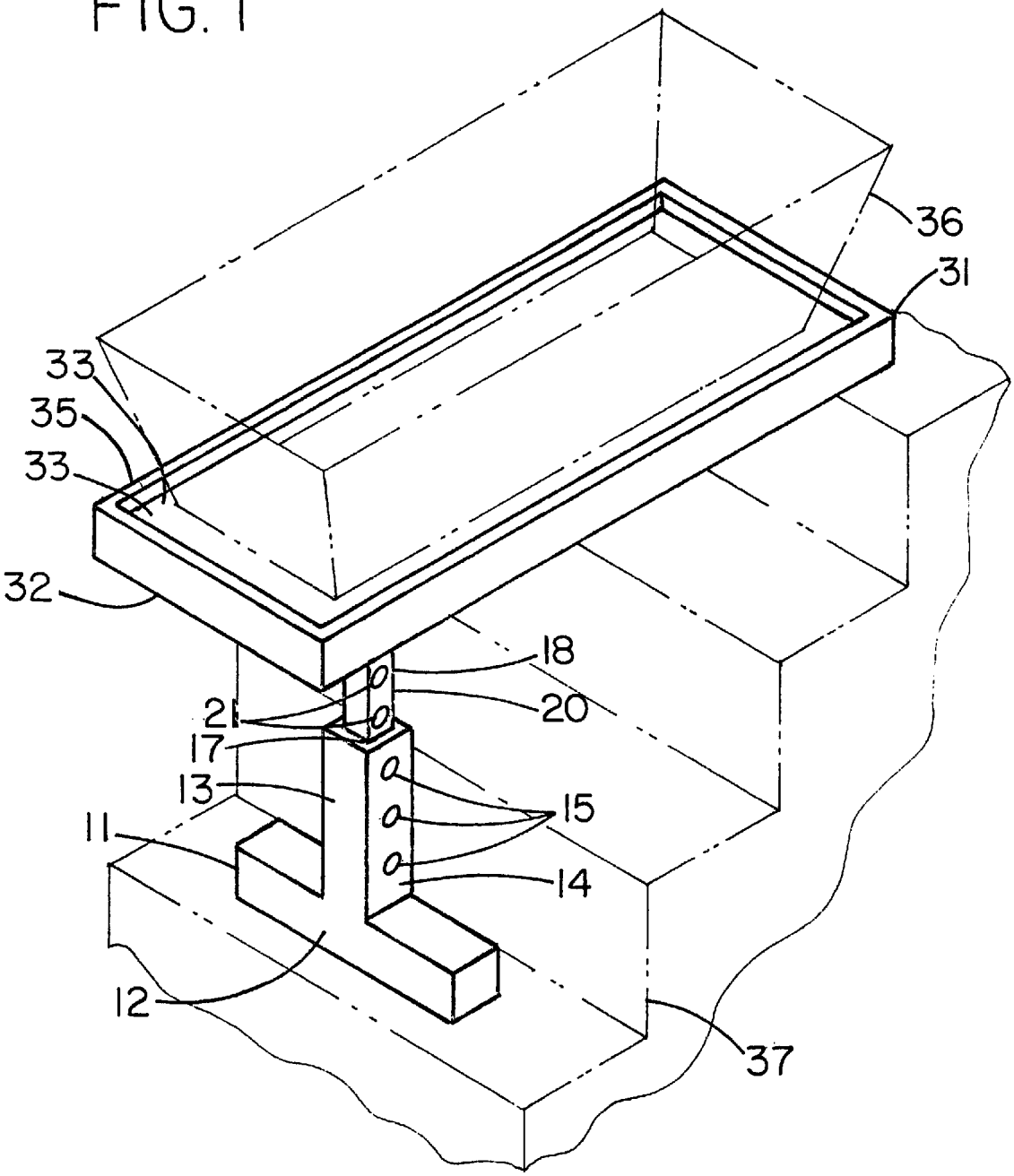
FIG. 1 is a perspective view of a new water trough support apparatus according to the present invention and shown in use.
Figure 2:
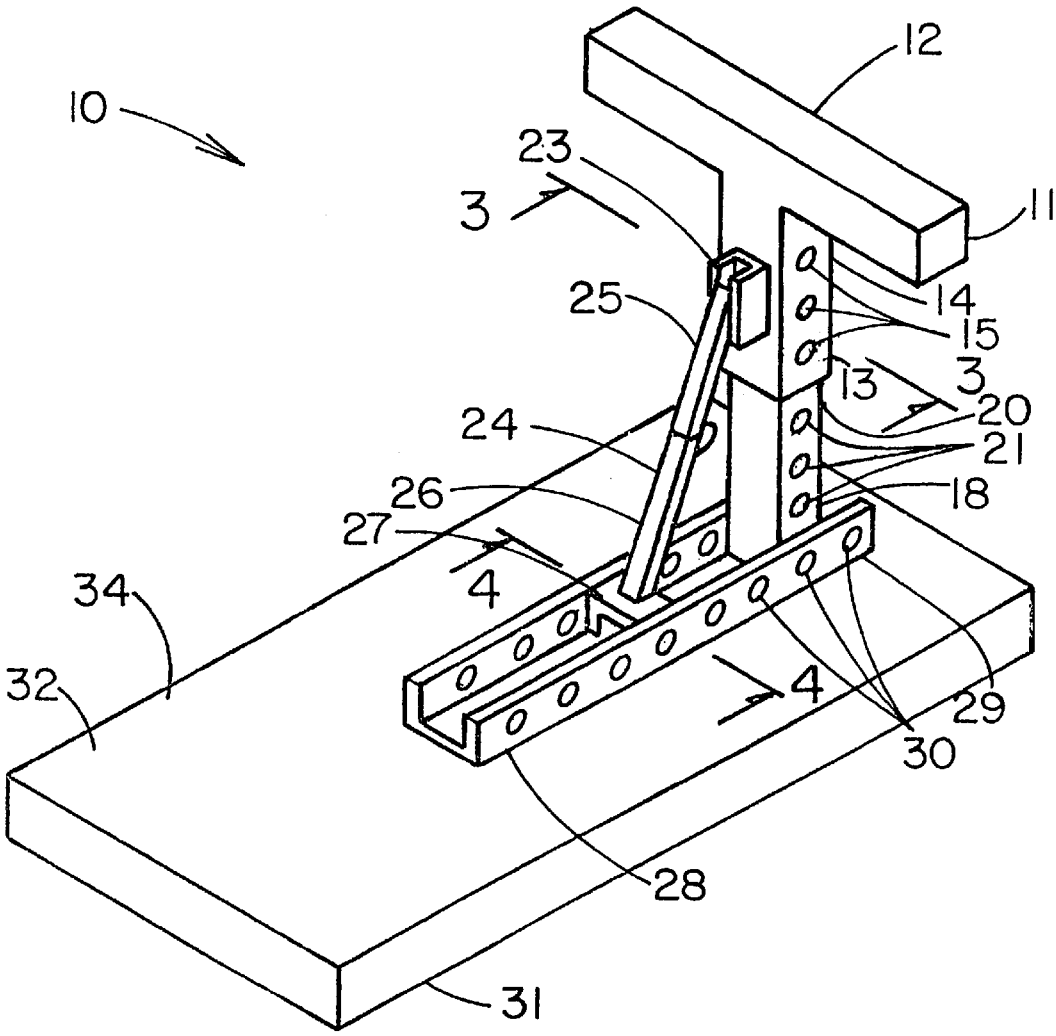
FIG. 2 is an inverted perspective view of the present invention.

With reference now to the drawings, and in particular to FIGS. 1 through 4 thereof, a new water trough support apparatus embodying the principles and concepts of the present invention and generally designated by the reference numeral 10 will be described.

As best illustrated in FIGS. 1 through 4, the water trough support apparatus 10 generally comprises an adjustable leg assembly having a length of approximately 20 inches, and also comprises a platform support member 28 being adjustably mounted upon the leg assembly. The leg assembly includes a base tubular leg member 11, and also includes an extendable tubular leg member 18 being adjustably received in the base tubular leg member 11, and further includes a mounting bracket 23 being securely and conventionally attached to the base tubular leg member 11, and also includes a bracket member 27 being adjustably and conventionally mounted to the platform support member 28, and further includes a leg brace 24 being pivotally and conventionally attached to the mounting bracket 23 and to the bracket member 24. The base tubular leg member 11 includes an elongate base portion 12 being adapted to rest upon a surface, and also includes an upright tubular portion 13 being integrally attached to an intermediate portion of the elongate base portion 12 and extending upwardly therefrom. The upright tubular portion 13 having a bore 16 extending therein through an open top end 17 and also having a plurality of holes 15 being spaced apart and extending through a wall 14 thereof and into the bore 16. The extendable tubular leg member 18 includes a bore 19 extending therethrough and also includes a plurality of holes 21 being spaced along and extending through a wall 20 thereof. The extendable tubular leg member 18 is movably disposed through the open top end 17 of the upright tubular portion 13. The extendable tubular leg member 18 is fastenable to the tubular upright portion 13 with a fastener 22. The mounting bracket 23 has a generally cross-sectional U-shape and is securely and conventionally attached to an exterior of the upright tubular portion 13. The leg brace 24 includes a first linkage member 25 having a first end and a second end which is pivotally and conventionally attached to the mounting bracket 23, and also includes a second linkage member 26 having a first end which is pivotally and conventionally attached to the bracket member 27 and also having a second end which is hingedly and conventionally attached to the first end of the first linkage member 25. The leg brace 24 has a length of approximately 6 to 8 inches.

A platform 31 is securely and conventionally mounted upon the platform support member 28. The platform support member 28 is an elongate U-shaped channel member having a plurality of holes being spaced along and being disposed through walls 29 thereof. The bracket member 27 is movably received in the U-shaped channel member 28. The holes 30 of the U-shaped channel member 28 is adapted to receive the fastening member 38 for fastening the bracket member 27 to the U-shaped channel member 28. The platform 31 includes a bottom wall 32 having a top side 33 and a bottom side 34 which is securely and conventionally mounted upon the U-shaped channel member 28, and also includes a raised edge being conventionally disposed along a perimeter of the top side 33 of the bottom wall 32. The platform 31 is adapted to support a water trough 36 thereupon with the platform 31 having a length of approximately 24 inches and a width of approximately 6 inches.

In use, the user sets up the leg assembly upon a step and adjusts the extendable tubular leg member 18 and also adjusts the leg brace 24 upon the platform support member 28 so that the platform 31 would be level and horizontal so that the water trough 36 can rest upon the platform 31 without water spilling out thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water trough support apparatus for providing a level work surface upon a plurality of different stairways, said apparatus comprising:

an elongate platform having a first end and a second end, wherein said first end is for positioning on an upper step of a stairway;

an elongate platform support member being mounted upon said platform, said platform support member extending from said second end towards said first end and being oriented substantially parallel to a longitudinal axis of said platform;

an adjustable leg assembly for resting upon a lower step of the stairway, said leg assembly being pivotally mountable at a plurality of user-selected positions along a length of said platform support member;

an adjusting means for adjusting a length of said leg assembly such that an extension of said leg assembly from said platform is adjustable;

a fixing means for selectively fixing an angular position of a longitudinal axis of said leg assembly with respect to a plane of said platform at selected positions between a position parallel to said plane and a position perpendicular to said plane;

wherein said leg assembly is positionable in a plurality of configurations so that said platform is positionable on different stairways in a substantially level horizontal manner when said first end of said platform is positioned on an upper step and said leg assembly is positioned on a lower step;

said leg assembly including a base tubular leg member and an extendable tubular leg member being adjustably received in said base tubular leg member, and further including a mounting bracket being securely attached to said base tubular leg member, and also including a bracket member being adjustably mounted to said platform support member, and further including a leg brace being pivotally attached to said mounting bracket and to said bracket member, said base tubular leg member including an elongate base portion being adapted to rest upon a surface, and also including an upright tubular portion being integrally attached to an intermediate portion of said elongate base portion and extending upwardly therefrom, said upright tubular portion having a bore extending therein through an open top end and also having a plurality of holes being spaced apart and extending through a wall thereof and into said bore, said extendable tubular leg member including a bore extending therethrough and also includes a plurality of holes being spaced along and extending through a wall thereof, said extendable tubular leg member being movably disposed through said open top end of said upright tubular portion, said extendable tubular leg member being fastenable to said tubular upright member with a fastener, said mounting bracket having a generally cross-sectional U-shape and being securely attached to an exterior of said upright tubular portion, said leg brace including a first linkage member having a first end and a second end which is pivotally attached to said mounting bracket, and also including a second linkage member having a first end which is pivotally attached to said bracket member and also having a second end which is hingedly attached to said first end of said first linkage member, said leg brace having a length of approximately 6 to 8 inches; and a platform being securely mounted upon said platform support member, said platform support member being an elongate U-shaped channel member having a plurality of holes being spaced along and being disposed through walls thereof, said bracket member being movably received in said U-shaped channel member, said holes of said U-shaped channel member being adapted to receive said fastening member for fastening said bracket member to said U-shaped channel member, said platform including a bottom-wall having a top side and a bottom side which is securely mounted upon said U-shaped channel member, and also includes a raised edge being disposed along a perimeter of said top side of said bottom wall, said platform being adapted to support a water trough thereupon, said platform having a length of approximately 24 inches and a width of approximately 6 inches.

* * * * *